United States Patent [19]

Gerber

[11] 4,140,037

[45] Feb. 20, 1979

[54] METHOD OF CUTTING SHEET MATERIAL WITH SCHEDULED SUPPLEMENTATION

[75] Inventor: Heinz J. Gerber, Hartford, Conn.

[73] Assignee: Gerber Garment Technology, Inc., South Windsor, Conn.

[21] Appl. No.: 789,848

[22] Filed: Apr. 22, 1977

[51] Int. Cl.[2] ..... B26D 3/10; B26D 5/30

[52] U.S. Cl. ..... 83/56; 83/62.1; 83/925 CC

[58] Field of Search ..... 83/56, 62, 62.1, 925 CC

[56] References Cited

U.S. PATENT DOCUMENTS

| | | | |
|---|---|---|---|
| 3,610,081 | 10/1971 | Gerber | 83/62 |
| 3,680,417 | 8/1972 | Wells | 83/62.1 X |
| 3,864,997 | 2/1975 | Pearl et al. | 83/56 X |

*Primary Examiner*—Willie G. Abercrombie

*Attorney, Agent, or Firm*—McCormick, Paulding & Huber

[57] ABSTRACT

A method of cutting sheet material with an automatically controlled cutting machine having a reciprocating cutting blade utilizes a schedule of auxiliary or supplemental machine motions to modify the basic or fundamental motions of a cutting blade and the sheet material under selected cutting conditions. The supplemental motions and corresponding conditions are determined in advance by means of cutting improvement tests and are recorded in a schedule correlating the motions and corresponding conditions. During subsequent cutting operations, the special motions are selectively extracted from the schedule as the corresponding cutting conditions arise, and the motions are then employed to improve the overall cutting process.

5 Claims, 10 Drawing Figures

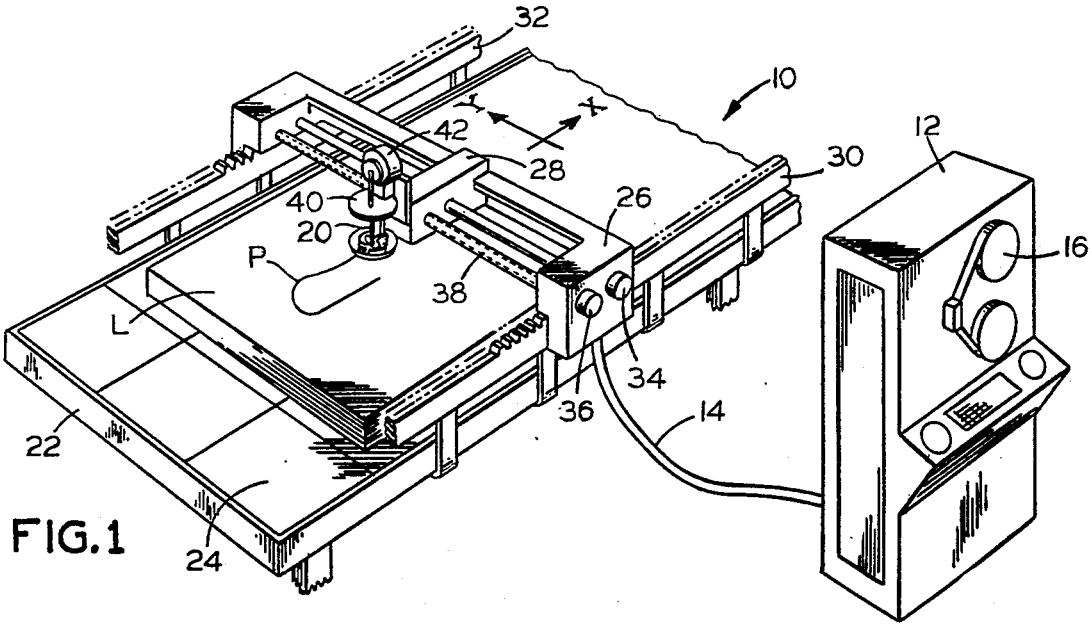
FIG. 1
FIG. 2
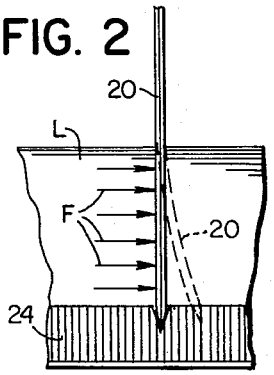
FIG. 3
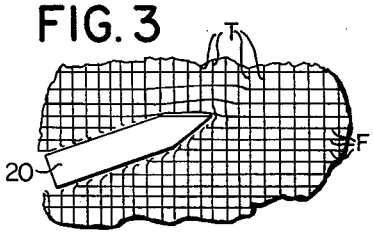
FIG. 4
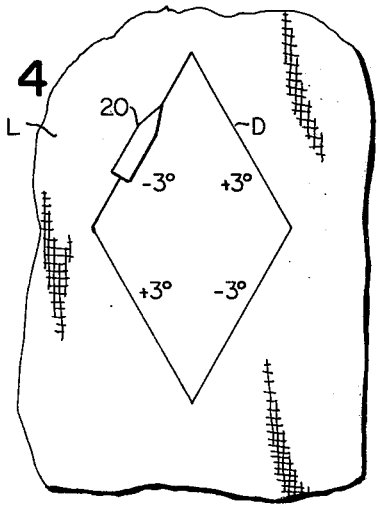
FIG. 5
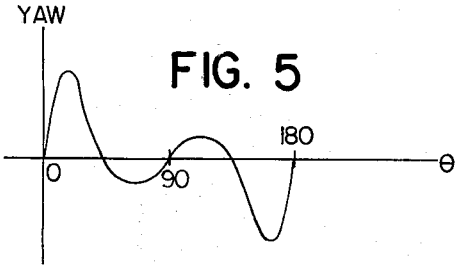
FIG. 10
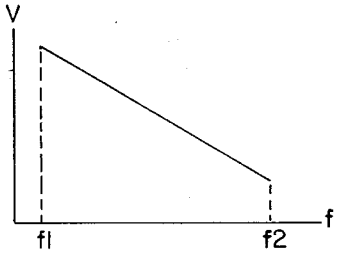

METHOD OF CUTTING SHEET MATERIAL WITH SCHEDULED SUPPLEMENTATION

CROSS REFERENCE TO RELATED APPLICATIONS

This application contains subject matter disclosed in a copending application Ser. No. 790,035 filed Apr. 22, 1977 by the same inventor and entitled Method and Apparatus for Cutting Sheet Material With Improved Accuracy and another copending application Ser. No. 790,149 filed Apr. 22, 1977 by the inventor entitled Closed Loop Method and Apparatus for Cutting Sheet Material.

BACKGROUND OF THE INVENTION

The present invention relates to a method of cutting sheet material with a cutting blade and, more particularly, relates to a method by which the relative motions of a cutting blade and sheet material are modified with scheduled supplemental motions to improve cutting accuracy. The method has particular utility in cutting layups of limp sheet material with automatically controlled cutting machines.

Automatically controlled cutting machines such as disclosed and described in U.S. Pat. Nos. 3,855,887 and 3,864,997 having the same assignee as the present invention have been known and used for some time for cutting various types of sheet material particularly limp sheet material such as fabrics, paper, cardboard, leather synthetics, rubber and others. Generally such automatically controlled machines derive information from a marker defining the contours or cutting paths to be followed. A marker is an array of closely packed pattern pieces positioned relative to one another in the same manner in which they are cut from the sheet material. In order to convert the marker information into machine commands, the cutting paths are reduced to point data by a digitizer, and then the digitized data is converted into basic or fundamental machine command signals which are received by the automatic machine and which guide a cutting blade or other cutting tool in the material along cutting paths corresponding to the patterns and contours in the marker. Alternatively, line followers or other instruments may track the patterns or contours in the marker and provide information which is converted into the fundamental machine commands.

A special technique for controlling the cutting blade as it advances along a cutting path in a layup of sheet material is disclosed in the above-referenced U.S. Pat. Nos. 3,855,887 and 3,864,997. In particular, a yawing technique comprised of rotating the cutting blade slightly out of a position tangent to the cutting path is utilized to control a reciprocating cutting blade as it advances along a cutting path in close proximity to adjacent cuts. The rotation is in a direction which orients the blade away from the previous, adjacent cut and prevents the blade from jumping into the cut near the point of tangency due to unbalanced lateral loading of the blade. In addition, the feed rate of the cutting blade may be reduced at the same time, especially with reciprocating cutting blades, in order to refine the cutting operation by increasing the number of cutting strokes per unit length of cutting path. The yaw and reduced feed rate commands are contained within the computer controlling the cutting machine, and are selectively drawn upon in accordance with previously recorded data.

Such special techniques for controlling the motions of a cutting blade cause the blade to track a desired cutting path with minimal error in spite of complex loading, particularly in multi-ply layups of sheet material. Stress and strain produced within the blade by the loading cause the blade to bend and deviate from a desired cutting path in spite of the accuracy with which servomechanisms or other positioning mechanisms locate the blade. Without special techniques, the deviations are often sufficient to produce cutting errors which are too significant to be ignored.

Several objects are achieved by the special techniques of controlling blade motions. First of all, cutting is carried out with greater accuracy and uniformity. It is highly desirable to have uniformity among pattern pieces which are cut from different layers of a multi-ply layup of sheet material because such uniformity enables pattern pieces to be used interchangeably. An item of upholstery or a garment can therefore be assembled with greater ease and more consistent quality.

Secondly, with greater assurance that the cutting blade will track a desired cutting path, pattern pieces may be more closely packed in the marker. Closer packing conserves material and since material is a significant factor in the cost of the finished product, the product can be manufactured at a lower cost.

It is a general object of the present invention to provide a method for establishing useful special cutting techniques and for utilizing those techniques when established to improve overall cutting performance.

SUMMARY OF THE INVENTION

The present invention resides in a method of cutting sheet material with an automatically controlled cutting machine.

Initially, cutting tests are performed on the sheet material with the cutting machine by moving the blade, and sheet material relative to one another in cutting engagement. The blade may for example be a reciprocating cutting blade. The tests are conducted under selected cutting conditions which in general produce low accuracy cuts, and then special or supplemental motions of the blade and material, which aid the cutting blade and improve the overall performance of the cutting machine are determined.

After a plurality of cutting tests have been conducted, and the precise special motions have been determined, a schedule of the special motions correlated with the selected cutting conditions is established. The schedule is recorded in a memory in the automatically controlled cutting machine or elsewhere for future use. During subsequent cutting operations, the cutting blade and sheet material are moved relative to one another along a desired cutting path, and the schedule of special motions is utilized as the corresponding cutting conditions arise. Thus, if for example, the schedule has been recorded in a computer memory which controls the cutting operation, the special motions can be combined with the more fundamental motions calculated or otherwise generated by the computer whenever the computer recognizes one or more of the selected cutting conditions or whenever the machine is commanded to use the special motions by the machine operator who recognizes the special cutting conditions.

Cutting tests under selected cutting conditions permit the precise value or magnitude of special motions to be determined experimentally by empirical or other processes so that cutting can be executed without limitation to conventional cutting techniques. After establishment, the schedule of special motions and corresponding cutting conditions permits subsequent cutting operations to be carried out with greater accuracy and ease and thereby improves the overall performance of an automatically controlled cutting machine.

BRIEF DESCRIPTION OF THE DRAWINGS

FIG. 1 is a perspective view of an automatically controlled cutting machine in which the present invention is employed.

FIG. 2 is a cross sectional view of a sheet material layup illustrating the effects of lateral loading on a cutting blade as the blade advances through the material.

FIG. 3 is a fragmentary plan view of the cutting blade moving through a woven sheet material at an angle to the material fibers.

FIG. 4 is a fragmentary plan view of a sheet material layup and illustrates one method of testing to determine special motions which improve the cutting operation.

FIG. 5 is a diagram illustrating an exemplary schedule of yaw motions that could be established by the testing method of FIG. 4.

FIG. 10 is a diagram representing a schedule of feed rates as a function of fore-and-aft forces on the cutting blade.

DESCRIPTION OF THE PREFERRED EMBODIMENTS

Figure 6:
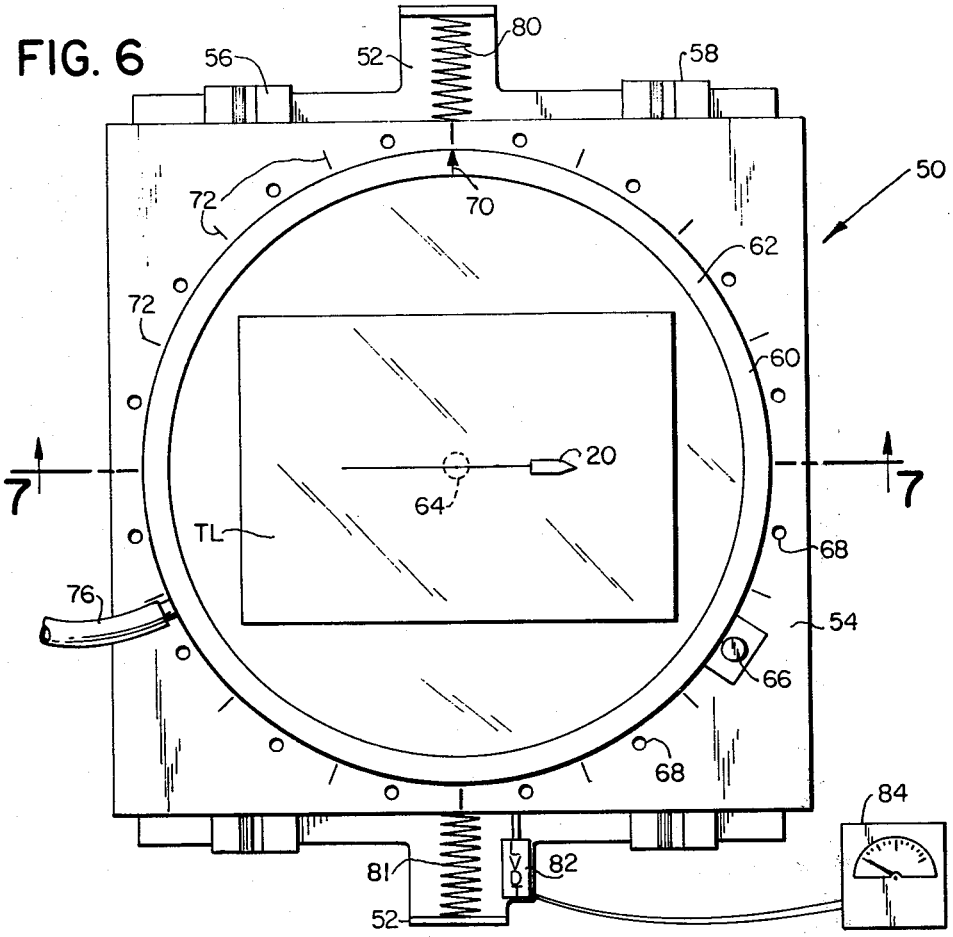
FIG. 6 is a plan view of a test fixture for determining special cutting commands in accordance with another testing method.

FIG. 1 illustrates an automatically controlled cutting machine, generally designated 10, of the type shown and described in greater detail in U.S. Pat. No. 3,955,887 having the same assignee as the present invention. The cutting machine is utilized to cut single or multi-ply layups of sheet material comprised of woven or nonwoven fabrics in accordance with pre-established cutting paths which may define, for example, a marker of pattern pieces. The illustrated machine is a numerically controlled machine having a controller or computer 12 serving the function of a data processor, and a cutting table 22 which performs the cutting operation on the sheet material in response to machine commands transmitted to the table from the computer through a control cable 14. In digital form, the computer 12 reads digital data from a program tape 16 defining the contours of cutting paths or pattern pieces to be cut, and generates the machine command signals which guide a reciprocating cutting blade 20 over the table as the cutting operation is carried out. The present invention, however, is not limited to the disclosed numerical control system and has utility with other real time or preprocessed analog or digital data systems including line followers such as shown and described in the referenced copending application Ser. No. 790,035 entitled *Method and Apparatus for Cutting Sheet Material With Improved Accuracy.*

The cutting table 22 as disclosed has a penetrable bed 24 defining a flat surface supporting the layup L during cutting. The bed may be comprised of a foam material or preferably a bed of bristles which can be easily penetrated by the reciprocating cutting blade 20 without damage as a cutting path P is traversed. The bed may also employ a vacuum system such as illustrated and described in greater detail in U.S. Pat. No. 3,495,492 for compressing and rigidizing the layup firmly in a fixed position on the table. The invention, however, can also be utilized with non-penetrable blades and cutting tables such as shown in U.S. Pat. No. 3,245,295 to Mueller.

The cutting blade 20 is suspended above the support surface of the bed 24 by means of an X-carriage 26 and a Y-carriage 28. The X-carriage translates back and forth in the illustrated X-coordinate direction on a set or racks 30 and 32. The racks are engaged by pinions driven by an X-drive motor 34 in response to command signals from the computer 12. The Y-carriage 28 is mounted on the X-carriage 26 for movement relative to the X-carriage in the Y-coordinate direction and is translated by the Y-drive motor 36 and a lead screw 38 connected between the motor and carriage. Like the drive motor 34, the drive motor 36 is energized by command signals from the computer 12. Coordinated movements of the carriages 26 and 28 are produced by the computer in response to the digitized data taken from the program tape 16 and guide the reciprocating cutting blade 20 along the cutting path P. Thus, the cutting blade is utilized to cut pattern pieces over any portion of the table supporting the sheet material.

The cutting blade 20 is suspended in cantilever fashion from an adjustable platform 40 attached to the projecting end of the Y-carriage 28. The adjustable platform elevates the sharp, leading cutting edge of the blade into and out of cutting engagement with the sheet material. The blade is reciprocated by means of a drive motor 42 supported on the platform 40. Another motor (not shown) on the platform rotates or orients the blade about a $\theta$-axis perpendicular to the sheet material and generally aligns the blade with the cutting path at each point. For a more detailed description of the blade driving and supporting mechanism, reference may be had to U.S. Pat. No. 3,955,458 issued May 11, 1976 to the assignee of the present invention. Of course, other types of cutting blades such as band blades and rotary blades may be used.

As mentioned above in connection with U.S. Pat. No. 3,855,887 the computer 12 produces machine commands which regulate the operation of the drive motors 34 and 36 as well as the motors which orient the cutting blade and lift the cutting blade in and out of cutting engagement with the sheet material. It is common and well known that the computer utilizes algorithms to convert the digitized or other contour data into basic or fundamental machine commands that translate the cutting blade along the cutting path generally tangent to the path at each point and at given feed rates. However, there are many special circumstances or conditions in which the fundamental commands are inadequate to produce high quality, high accuracy cutting of the material, and it is such circumstances to which the present invention is directed.

FIG. 2 illustrates a cutting blade 20 from the rear as it advances through the layup L of sheet material spread on the bed 24 comprised of bristles. Forces F generated between the advancing cutting blade and material are shown operating on the left side of the blade to produce an unbalanced lateral loading or force which bends and deflects the blade to the position illustrated in phantom.

It will be readily apparent that the lower plies of the sheet material cut by the blade when it is deflected will have a slightly different shape or contour than the upper plies due to the blade bending. Obviously, such bending and its results are undesirable when pattern pieces and other products should be cut with high accuracy.

The forces F generated on the cutting blade as it advances can be attributed to a number of factors, such as the layup, the strength of the cloth fibers, the angle of the fibers and cutting path, the sharpening angle of the blade, the sharpness of the blade and others. For example, FIG. 3 illustrates the cutting blade in a plan view advancing through woven material having fibers F extending in one direction and fibers T extending in a transverse direction. As the blade cuts through the fibers as the angle illustrated, the tapered left forward side of the blade is almost parallel to the fibers F and due to the parallelism, the blade tends to push the fibers slightly as shown before they are cut. Correspondingly, the fibers develop reaction forces F as shown in FIG. 2 which forces produce the blade bending. Consequently, the unbalanced lateral loading of the cutting blade may vary with the angular relationship between the cutting path or blade and the fibers comprising the material being cut. The strength of the unbalanced forces would also depend upon the sharpness of the blade, the sharpening angle of the blade, the strength of the fibers F which is not necessarily the same as the strength of the fibers T and the depth of the layup through which the blade is cutting.

The unbalanced lateral forces on the blade can be counteracted by supplementing the fundamental blade motions with yaw so that the cutting blade is oriented at a slight angle to the cutting path which it traverses, the yaw or rotation occurring about an axis generally perpendicular to the sheet material and directing the blade slightly to one side of the cutting path from which the unbalanced forces are applied. By yawing the cutting blade a preselected amount as the blade advances along the cutting path, the accuracy with which the desired cutting path is tracked can be improved. For optimum overall performance, the amount of the yaw should be determined with some accuracy.

In accordance with one aspect of the present invention, FIG. 4 illustrates a cutting test by which the amount of yaw can be determined for selected cutting conditions. The cutting blade 20 is made to traverse a diamond-shaped test pattern D in a layup L of a selected, woven sheet material on the cutting table 22 of FIG. 1. Initially, the blade is guided only by fundamental commands produced in the computer 12 which ideally advance the cutting blade tangentially around the pattern D. However, due to the particular angular relationships of the cutting blade and the fibers in the material and other selected cutting conditions, unbalanced lateral forces and other variables influence the actual cuts produced by the blade along each side of the test pattern. The initial test cut generated with fundamental commands is then inspected visually, and the departure of the blade from the desired path along each side of the pattern is determined. The cutting test is then repeated at another uncut location in the layup L; however, during the second test, selected amounts of yaw may be added to the fundamental commands on each of the respective sides of the diamond-shaped pattern D, the amount being selected in accordance with the results visually observed from the initial cutting test. For example, if the lower plies of the layup indicated that the blade 20 was deflected to the right side of the cutting path along one side of the diamond-shaped path, then an appropriate amount of yaw to the opposite side of the cutting path would be added for the second cutting test. By repeating the test several times and examining the results, it is possible to determine ideal values of yaw for the particular cutting conditions existing during the cutting tests. The four numerical values +3° and −3° illustrated in FIG. 4 could represent the preferred values of yaw determined after several cutting tests under the illustrated set of conditions.

Once the yaw values have been established for one test pattern, the shape of the diamond may be changed by flattening the diamond or by rotating the diamond in order to conduct another set of tests with new angular relationships between the cutting path and the fibers of the material. By performing a plurality of cutting tests with various angular relationships between the cutting paths and the fibers and interpolating the results, a full schedule of yaw values can be determined as a function of all angular relationships of the cutting path and the fibers. Such a schedule is illustrated in FIG. 5 and includes the results indicated in the test illustrated in FIG. 4. In particular, the ideal values of yaw vary over a 180° change in direction of the cutting path relative to the fibers, and one-half of the schedule is the mirror image of the other half. Numerous other schedules both symmetric and asymmetric can be determined by testing other woven materials having different fibers in the weave. The schedule need not necessarily contain mirror images, and the cycle of values may be more or less than 180°. Schedules also can be developed for knitted and other materials.

After a schedule of supplemental yaw values has been determined, it is utilized in subsequent cutting operations whenever the corresponding cutting conditions arise. The schedule may be utilized by recording it in the computer 12 for selection by the machine operator in the manner taught in the above-referenced copending U.S. application Ser. No. 790,035 entitled *Method and Apparatus for Cutting Material with Improved Accuracy.* Briefly the computer 12 generates the fundamental machine commands which, in the absence of external influences on the cutting blade, produce fundamental motions guiding the blade tangentially along the desired cutting path. When the layup of sheet material spread on the cutting table has the weave and other characteristics for which a schedule of supplemental yaw motions has been determined, the operator of the cutting machine selects the optional program in which the schedule is defined. The cutting blade and sheet material then move in cutting engagement relative to one another in response to combined fundamental and supplemental machine commands. The commands produce a combination of fundamental and special blade motions so that the cutting blade traverses a cutting path with yaw motions determined by the previous cutting tests. The resulting paths or patterns cut in the sheet material are formed more accurately and the overall performance of the cutting machine improves.

The above described cutting tests for determining special motions or maneuvers of the cutting blade rely upon visual examination of the cuts and a trial-and-error process of achieving improved cutting performance. A more direct method of testing comprises sensing a particular cutting parameter affected by the relative motion of the cutting blade and sheet material, and then adjusting or supplementing the relative motion until the sensed parameter acquires a preferred or desired value correlated with improved cutting performance.

It was shown and described above in connection with FIGS. 2 and 3 that unbalanced lateral forces on the cutting blade produce cutting error. Accordingly, when such forces are counteracted and nulled out, the cutting blade traverses the cutting path without bending and deflecting, and the resulting cuts are more accurate.

Figure 7:
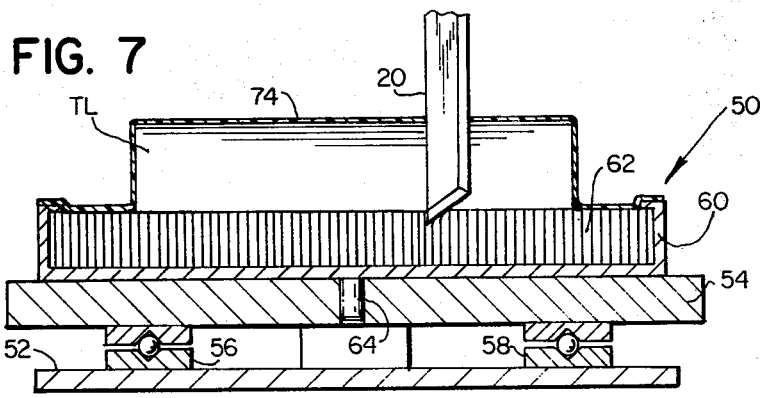
FIG. 7 is a cross sectional view of the test fixture in FIG. 6.

With the above in mind, a test fixture such as illustrated in FIGS. 6 and 7 is utilized to measure cutting forces during tests. The fixture, generally designated 50, includes a stationary base platen 52 on which a moving platen 54 is mounted by a set of parallel, low friction ways 56 and 58. The base platen 52 is positioned directly on the bed 24 of the cutting table 22 in FIG. 1 and is fixedly secured in position so that the platen 54 is movable relative to the bed in one given direction, for example, the X-coordinate direction. Located centrally on the moving platen 54 is a turntable 60 which holds bristled mats 62 defining a penetrable bed substantially identical to the bed 24. The turntable 60 is held rotatably on the moving platen 54 by means of a pivot pin 64 inserted in a corresponding hole of the platen. A lock 66 mounted on the periphery of the turntable screws into or otherwise attaches to any one of a series of tapped holes 68 along the periphery of the turntable so that the table can be rotatably indexed to a number of different angular positions relative to the coordinate axes of the cutting machine 10. The index mark 70 on the turntable 60 and the angular index marks 72 corresponding with the holes 68 on the platen 54 permit the angular relationship of the turntable and the coordinate axes to be accurately determined.

In a cutting test, a test layup TL of sheet material is positioned on the bristled mats 62 for cutting by the blade 20 of the machine 10. A vacuum to hold the layup and make it more rigid for sensing forces can be drawn within the layup by covering the layup and mats with an air impermeable overlay 74 and drawing a vacuum through the bristles by means of the vacuum hose 76 and connected pump (not shown). To sense forces generated parallel ways 56 and 58 by the interaction of the blade and sheet material during a cutting test, a pair of restraining springs 80, 81 extend between the stationary base platen 52 and the moving platen 54, and a position transducer in the form of a linearly variable differential transformer (LVDT) 82 measures the movement of the platen 54 or the compression of the springs 80, 81 which is proportional to the generated forces. The sensed forces can be displayed directly on a calibrated meter 84.

To measure unbalanced lateral forces produced by the cutting blade 20, the blade is translated through the test layup TL along a cutting path which extends perpendicular to the ways 56 and 58. As forces are read on the meter 84, the operator of the machine manually introduces a limited amount of yaw through the computer 12 and determines the amount of yaw required to null out the forces. Such value of yaw is correlated with the cutting angle between the fibers in the layup and the orientation of the cutting blade and becomes one value of the yaw schedule. Another value in the schedule is determined by rotating the turntable 60 to a new angular position relative to the platen 54 and repeating the cutting test in a virgin or uncut portion of the layup TL. From this process a series of yaw values and corresponding cutting angles is determined and by interpolation a complete schedule of yaw values such as shown in FIG. 5 may be established.

Figure 8:
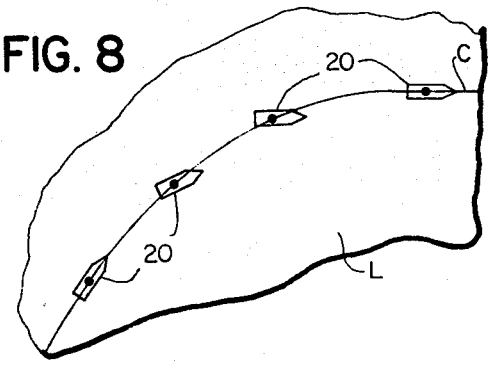
FIG. 8 is a schematic plan view of a sheet material layup illustrating special yaw motions at successive points along the cutting path.

The test fixture 50 can also be used to establish schedules of other cutting parameters which may be used to improve the cutting operation. For example, as described in the above referenced application, Ser. No. 790,035 entitled *Method and Apparatus for Cutting Sheet Material With Improved Accuracy,* it is sometimes desirable to utilize yaw where the cutting path being traversed is curved. FIG. 8 illustrates a curved cutting path C, and the position of the cutting blade 20 is shown at successive stations along the path. It will be noted that where the path is generally straight, the blade is maintained in alignment with the cutting path but where the path is curved, the blade is yawed towards the inside of the curve by a slight amount.

The preferred amount of yaw for curves under selected conditions can also be determined by means of the test fixture 50 in FIGS. 6 and 7. In particular, the cutting blade 20 is positioned transversely along the radial of the turntable which is parallel to the guide ways 56 and 58. The turntable is then rotated by hand or by a motor (not shown) and the blade held stationary cuts an arcuate or circular cutting path of selected radius in the test layup TL. The radius of curvature is measured from the pivot pin 64 and the lateral loading produced by the cutting blade is measured by the transducer 82 and meter 84. By adjusting the amount of yaw through the computer 12, the machine operator can null out the lateral forces and determine that amount of yaw required for a given curvature in the particular type of sheet material under test. By repeating the test with the cutting blade 20 situated at various radii from the pin 64, a schedule of yaw as a function of curvature can be determined for null loading in the material under test.

Figure 9:
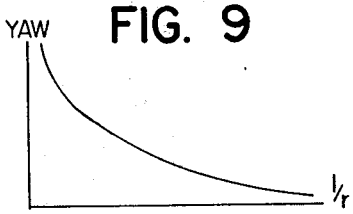
FIG. 9 is a diagram representing the schedule of yawing motions illustrated in FIG. 8.

FIG. 9 illustrates an exemplary schedule of yaw and curvature. As curvature (equal to the reciprocable radius) increases, the amount of yaw decreases and asymptotically approaches zero at infinite curvature corresponding to a straight cutting path.

The test fixture 50 may also be used to measure fore-and-aft forces applied to the cutting blade and from these forces determine an appropriate feed rate schedule. For example, in FIG. 10 a feed rate V is illustrated as a function of fore-and-aft forces. The schedule indicates a generally linear relationship within predefined upper and lower limits. Fore-and-aft forces below some minimal value F1 determined by cutting tests with the fixture 50 indicate that the cutting blade is not engaged with the material or broken and, therefore, the forward motion of the cutting blade should be terminated. As the blade grows duller due to extended cutting, the rearward force on the blade increases and it is desirable in such situations to reduce the feed rate in order to provide more cutting strokes per unit length of the cutting path. When the fore-and-aft force reaches an upper limit F2 determined by cutting tests with the fixture 50, the blade is too dull to effectively cut the material without danger of blade failure, and the feed is then terminated or a signal is generated to initiate a sharpening operation, assuming that the cutting machine has an automatic blade sharpener. Thus, the fixture 50 may be utilized to establish a schedule of feed rates which vary between upper and lower force limits determined from the tests conducted on the layup TL.

In conducting tests to measure fore-and-aft forces on the cutting blade, the fixture 50 is positioned on the bed 24 of the cutting table 22 and is held fixedly in position on the table. The blade is oriented in a direction parallel with the ways 56 and 58 and is advanced through the layup parallel to the ways. In this manner, the force indicated on the meter 84 corresponds to the fore-and-aft blade forces rather than lateral forces described above.

In summary, a method for cutting sheet material has been disclosed in which special or supplemental motions of the cutting blade and sheet material are determined by performing cutting tests under selected cutting conditions. The supplemental motions which aid the cutting blade under the selected cutting conditions are then collected and recorded to establish a schedule of the motions and conditions, and the schedule is used in subsequent cutting operations whenever the corresponding cutting conditions arise.

While the present invention has been described in a preferred embodiment, it will be understood that numerous modifications and substitutions can be had without departing from the spirit of the invention. For example, in the embodiments of the invention described above, tests are conducted in order to determine special yaw motions and feed rate motions. It will be understood, however, that other variables affecting a cutting operation, such as the stroking rate of the cutting blade can also be examined in cutting tests, and desired schedules and corresponding cutting conditions can be established for these other variables as well. It will be readily apparent that the test fixture 50 facilitates the measurement of force parameters of a cutting operation. It should, however, be understood that with other cutting parameters the fixture 50 or other test fixtures may be utilized for determinations of cutting schedules.

The established cutting schedules may also be activated in response to automatic data processing equipment. For example, in systems utilizing line followers, critical cutting conditions in a marker, such as points of tangency or close approach, may be identified as the points come into view. The line follower then activates a scheduled program to generate supplemental motions appropriate for the identified cutting conditions. In automated data processing systems, identification of the critical cutting conditions can also be obtained from data analysis. For example, the control computer 12 may include data analysis logic to identify the selected critical conditions where scheduled supplemental commands are needed. Also, automatic marker generators containing data processors frequently include a packing subroutine which bumps and moves the pattern pieces against one another until all of the pattern pieces are displayed in a marker requiring a minimal section of sheet material. The same processing of data defining the pattern pieces can identify many critical cutting conditions such as the points of tangency, close approach and extended parallel paths in closely adjacent relationship.

Scheduled correction of fundamental commands is one method of obtaining more accurate cutting but this correction can also be used in combination with other corrective systems such as disclosed in the above referenced copending application Ser. No. entitled Closed Loop Method and Apparatus for Cutting Sheet Material. Scheduled correction has utility not only with numerically controlled cutting machines such as shown and described, but may also be used with other types of cutting machines including those in which the cutting information is derived from templates and graphic representations of cutting paths by way of profile and line followers. Accordingly, the present invention has been described in several embodiments by way of illustration rather than limitation.

I claim:

1. A method of cutting sheet material with a controlled cutting machine having a cutting blade comprising the steps of:

performing cutting tests on the sheet material with the cutting machine under selected cutting conditions by advancing the blade in the sheet material in known maneuvers which produce lateral forces on the blade due to the interaction of the blade and material, sensing the lateral blade forces produced as the blade is advanced in the material, and orienting the blade at a yaw angle slightly away from the direction of advancement and toward the sensed lateral forces as the blade advances to counteract the lateral forces and reduce the sensed forces toward zero;

establishing a schedule of the yaw angles which reduce the lateral forces toward zero and the corresponding maneuvers as determined by the cutting tests; and then cutting sheet material thereafter along desired cutting paths by advancing the cutting blade and sheet material relative to one another and utilizing the schedule of yaw angles to control blade orientation when the corresponding maneuvers arise.

2. The method of claim 1 wherein the step of performing cutting tests includes placing the sheet material in a layup in a test fixture, and the sensing step is performed by measuring the lateral forces produced between the layup and the blade through the fixture.

3. The method of claim 1 for cutting a stack of woven sheet material wherein the step of performing cutting tests comprises advancing the cutting blade and sheet material relative to one another along a plurality of cutting paths each having a different angular relationship with the weave of the sheet material and the step of orienting comprises orienting the blade along each path to a yaw angle which nulls the sensed lateral forces on the blade.

4. The method of claim 3 wherein the sheet material has fibers extending in selected directions through the material; and the step of performing tests comprises moving the cutting blade and sheet material relative to one another along a plurality of cutting paths having different angular relationships with the fibers and the step of establishing a schedule establishes a schedule of the angles of the cutting paths relative to the fibers and the corresponding yaw angles.

5. A method of cutting sheet material with an automatically controlled machine having a cutting blade comprising:

advancing the cutting blade and the sheet material relative to one another in cutting engagement under known cutting conditions and with fundamental advancing motions to test the performance with which the machine traverses a desired cutting path;

sensing lateral forces applied to the blade by the sheet material as the blade is advanced by the fundamental advancing motions;

supplementing the fundamental advancing motions with blade yawing motions which null the sensed lateral forces on the advancing blade;

repeating the steps of advancing, sensing and supplementing for a plurality of cutting conditions, and then establishing a schedule of the supplemental yawing motions and corresponding cutting conditions; and executing a subsequent cutting of sheet material along a desired cutting path with fundamental motions and selected supplemental motions combined, the supplemental motions being selected from the schedule according to a correspondence of the tested cutting conditions and the actual cutting conditions that exist along the cutting path.

* * * * *